US011179773B2

(12) United States Patent
Kim

(10) Patent No.: US 11,179,773 B2
(45) Date of Patent: Nov. 23, 2021

(54) PLUNGER PRESSING DEVICE FOR MOLDING INGOT

(71) Applicant: Young Soo Kim, Gwangju-si (KR)

(72) Inventor: Young Soo Kim, Gwangju-si (KR)

( * ) Notice: Subject to any disclaimer, the term of this patent is extended or adjusted under 35 U.S.C. 154(b) by 0 days.

(21) Appl. No.: 16/863,493

(22) Filed: Apr. 30, 2020

(65) Prior Publication Data

US 2020/0368809 A1 Nov. 26, 2020

Related U.S. Application Data

(63) Continuation of application No. PCT/KR2018/010027, filed on Aug. 30, 2018.

(30) Foreign Application Priority Data

Aug. 31, 2017 (KR) ..... 20-2017-0004605
Nov. 2, 2017 (KR) ..... 20-2017-0005671

(51) Int. Cl.

| | |
|---|---|
| ***B22D 18/02*** | (2006.01) |
| ***B22D 7/06*** | (2006.01) |
| ***B22D 7/12*** | (2006.01) |

(52) U.S. Cl.
CPC ..... *B22D 18/02* (2013.01); *B22D 7/12* (2013.01); *B22D 7/06* (2013.01)

(58) Field of Classification Search
CPC ..... B22D 7/06; B22D 7/12; B22D 18/02
USPC ..... 164/47, 159, 271, 412
See application file for complete search history.

(56) References Cited

U.S. PATENT DOCUMENTS

2014/0252711 A1* 9/2014 Tropea ..... B25B 5/02 269/90

* cited by examiner

*Primary Examiner* — Kevin P Kerns
(74) *Attorney, Agent, or Firm* — Studebaker & Brackett PC

(57) ABSTRACT

Disclosed is an apparatus for pressing a plunger to form an ingot. The apparatus includes a base block having a tilted surface, a pair of guide rails disposed on left and right sides of the tilted surface of the base block, a support disposed on bottom ends of the guide rails and on which a molding frame is mounted, a sliding block which slides along the pair of guide rails and presses a plunger protruding upward from the molding frame, a pair of rotational frames coupled to be rotatable on hinges mounted below the pair of guide rails, and a pair of connection links having both longitudinal sides connected to the support and the rotational frames in a rotatable structure to move the sliding block downward when the rotational frames rotates downward.

3 Claims, 6 Drawing Sheets

PLUNGER PRESSING DEVICE FOR MOLDING INGOT

TECHNICAL FIELD

The present invention relates to an apparatus for pressing a plunger to form an ingot, and more particularly, to an apparatus for pressing a plunger to form an ingot which has a simple structure so as to decrease manufacturing costs and be simply operated to have excellent productivity.

Generally, in the case of dental prostheses such as dental crowns or dental bridges, ceramic is melted and molded to be formed and then fit in a tooth. Here, when ceramic is molded in a particular shape as described above, a method of inserting an ingot into a molding frame and then pressurizing the ingot is utilized.

Here, the ingot is a lump of casting formed by injecting melted crystallized glass into a mold or sand-cast to be molded in a certain shape which is generally a cylindrical shape.

The ingot is introduced into a molding frame and then pressurized by a plunger to be molded. Generally, equipment for pressurizing the plunger is very complicated and expensive.

Also, since it is complicated to operate a general plunger pressurizing apparatus, productivity is very low.

DISCLOSURE

Technical Problem

The present invention is directed to providing an apparatus for pressing a plunger to form an ingot which has a simple structure to be manufactured at a low cost and is simply operated to be conveniently used.

Technical Solution

One aspect of the present invention provides an apparatus for pressing a plunger to form an ingot. The apparatus includes a base block having a tilted surface, a pair of guide rails disposed on left and right sides of the tilted surface of the base block, a support disposed on bottom ends of the guide rails and on which a molding frame is mounted, a sliding block which slides along the pair of guide rails and presses a plunger protruding upward from the molding frame, a pair of rotational frames coupled to be rotatable on hinges mounted below the pair of guide rails, and a pair of connection links having both longitudinal sides connected to the support and the rotational frames in a rotatable structure to move the sliding block downward when the rotational frames rotates downward.

The support may be disposed at a right angle with the tilted surface.

A bottom surface of the sliding block and a top surface of the support may be parallel.

The sliding block may include a pair of sliding plates mounted on inner surfaces of the pair of guide rails and a pressing plate disposed to be parallel to the top surface of the support to connect the pair of side plates.

The apparatus may further include a handle which connects top ends of the pair of rotational frames.

The rotational frames may include hinge fastening holes coupled to the guide rails in a rotatable structure and link fastening holes coupled to the connection links in a rotatable structure. Here, a distance between the hinge fastening holes and the handle may be two times or greater than a distance between the hinge fastening holes and the link fastening holes.

The connection links may include frame fastening holes coupled to the rotational frames in a rotatable structure and block fastening holes coupled to the sliding block in a rotatable structure. Here, two or more of the frame fastening holes and two or more of the block fastening holes may be arranged along a longitudinal direction of the connection links.

Advantageous Effects

An apparatus for pressing a plunger to form an ingot according to the present invention may have a simple structure to be manufactured at a low price, be simply operated to be conveniently used, and quickly perform another pressing process after an initial pressing process so as to increase productivity.

BEST MODE

Figure 1:
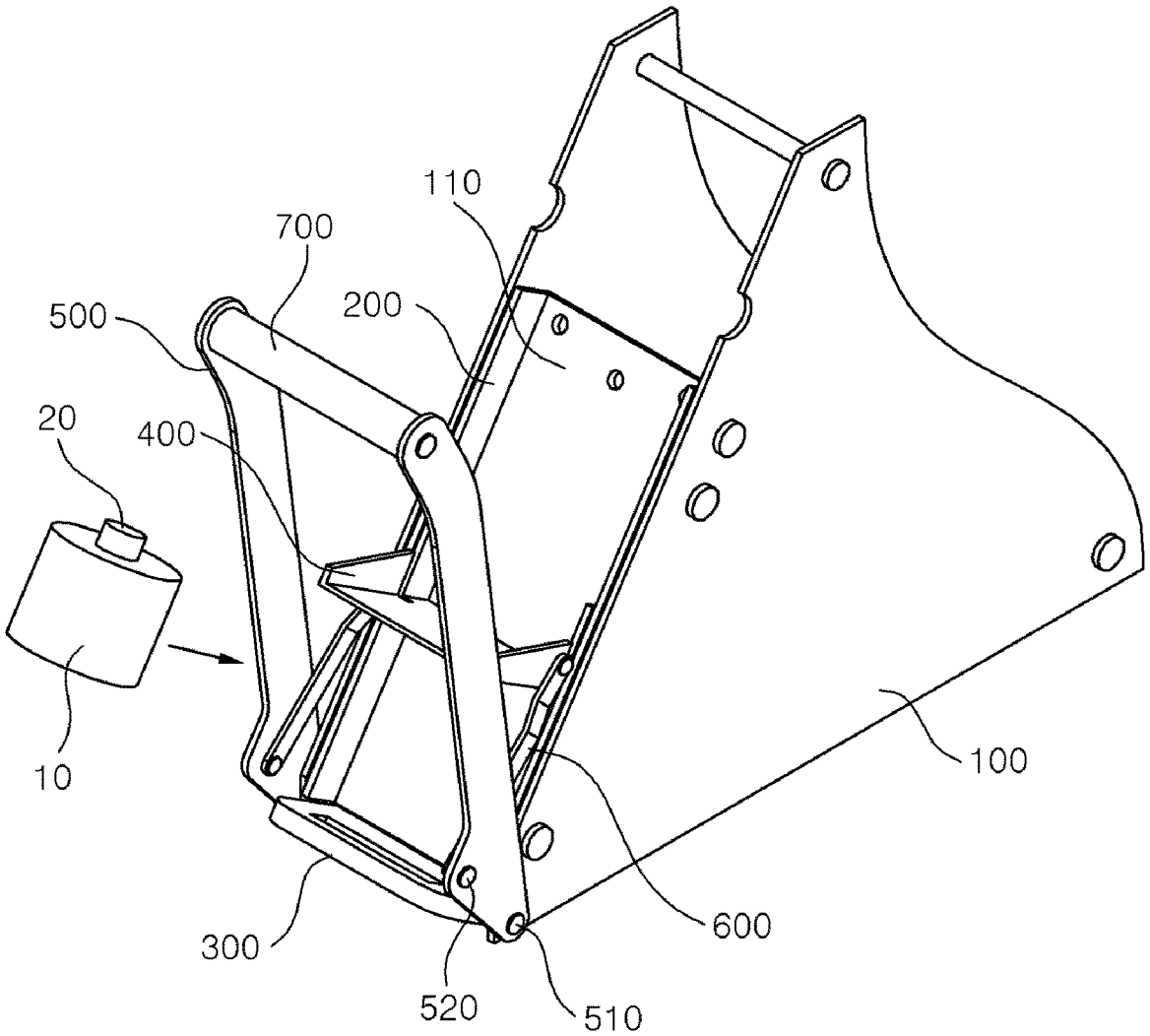
FIG. 1 is a perspective view of an apparatus for pressing a plunger to form an ingot according to the present invention.

The present invention is directed to providing an apparatus for pressing a plunger to form an ingot. The apparatus includes a base block 100 having a tilted surface 110, a pair of guide rails 200 disposed on left and right sides of the tilted surface 110 of the base block 100, a support 300 disposed on bottom ends of the guide rails 200 and on which a molding frame 10 is mounted, a sliding block 400 which slides along the pair of guide rails 200 and presses a plunger 20 protruding upward from the molding frame 10, a pair of rotational frames 500 coupled to be rotatable on hinges mounted below the pair of guide rails 200, and a pair of connection links 600 having both longitudinal sides connected to the support 300 and the rotational frames 500 in a rotatable structure to move the sliding block 400 downward when the rotational frames 500 rotates downward.

Modes of the Invention

Hereinafter, embodiments of the present invention will be described in detail with reference to the drawings.

FIG. 1 is a perspective view of an apparatus for pressing a plunger to form an ingot according to the present invention.

The apparatus for pressing the plunger to form the ingot according to the present invention relates to a pressing apparatus which presses a plunger 20 for forming an ingot mounted in a molding frame 10. The apparatus has a simple structure to be manufactured at a low price, is simply operated to increase productivity, and is capable of quickly performing another pressing process after an initial pressing process so as to increase productivity.

That is, the apparatus for pressing the plunger to form the ingot according to the present invention includes a base block 100 having a tilted surface 110, a pair of guide rails 200 disposed on left and right sides of the tilted surface 110 of the base block 100, a support 300 disposed on bottom ends of the guide rails 200 and on which a molding frame 10 is mounted, a sliding block 400, which slides along the pair of guide rails 200 and presses a plunger 20 protruding upward from the molding frame 10, a pair of rotational frames 500 coupled to be rotatable on hinges mounted below the pair of guide rails 200, and a pair of connection links 600 having both longitudinal sides connected to the support 300 and the rotational frames 500 in a rotatable structure to move the sliding block 400 downward when the rotational frames 500 rotates downward.

The sliding block 400 is mounted between the pair of guide rails 200 to perform reciprocation only along a longitudinal direction of the guide rails 200. When the rotational frames 500 are rotated downward (rotated counterclockwise in FIG. 1) by a user, the sliding block 400 connected to the rotational frame 500 by the connection links 600 is moved downward along the rotational frames 500. On the other hand, when the rotational frames 500 are rotated upward (rotated clockwise in FIG. 1) by the user, the sliding block 400 connected to the rotational frames 500 by the connection links 600 is moved upward along the rotational frames 500.

Accordingly, when a worker rotates a rotating press on a hinge after the molding frame 10 is mounted on the support 300, the connection links 600 connected to the rotating press move downward and the sliding block 400 connected to the connection links 600 also moves downward so as to press the plunger 20 protruding upward from the molding frame 10.

When the plunger 20 is pressed as described above, an ingot (not shown) mounted in the molding frame 10 is pressed by the plunger 20 and is formed in a particular preset shape.

Here, the molded shape of the ingot is determined according to a shape of the molding frame 10. Since a process of the ingot being pressed in the molding frame 10 to be formed in the particular shape as described above is equally applied in the art, a detailed description thereof will be omitted.

Meanwhile, since the molding frame 10 is generally manufactured such that a bottom surface and a side surface meet at a right angle, the support 300 may be disposed at a right angle with the tilted surface 110 such that the side surface of the molding frame 10 is mounted on the tilted surface 110 when the bottom surface of the molding frame 10 is mounted on a top surface of the support 300.

Also, since the plunger 20 is inserted into the molding frame 10 in a direction parallel to a longitudinal direction of the molding frame 10, it is necessary to set the sliding block 400 to press the plunger 20 in a direction parallel to the longitudinal direction of the molding frame 10. When the direction in which the sliding block 400 presses the plunger 20 is dislocated from the longitudinal direction of the molding frame 10, not only may the plunger 20 be easily pressed into the molding frame 10 but the plunger 20 may also be damaged while being pressed. Accordingly, a bottom surface of the sliding block 400 and a top surface of the support 300 may be arranged to be parallel to each other.

Also, when the rotational frames 500 and the connection links 600, which transfer a lifting force to the sliding block 400, are mounted on only one side of the sliding block 400, left and right sides of the sliding block 400 do not uniformly move upward and downward and may tilt leftward or rightward.

When the sliding block 400 tilts leftward or rightward as described above, a great frictional force occurs between the sliding block 400 and the guide rails 200 such that there is a difficulty in moving the sliding block 400 upward.

Accordingly, the rotational frames 500 and the connection links 600 may be installed on both left and right sides of the sliding block 400. Here, to allow the sliding block 400 to be moved downward while left and right balance of the sliding block 400 is adjusted, it is necessary to rotate the pair of rotational frames 500 at the same time and same speed. Here, when the pair of the rotational frames 500 are configured to be independently rotated, it is very difficult to rotate the pair of rotational frames 500 at the same time and same speed.

Accordingly, the apparatus for pressing the plunger to form the ingot according to the present invention may be configured to further include a handle 700 which connects top ends of the pair of rotational frames 500. When the top ends of the pair of rotational frames 500 are connected by one handle 700 as described above, the user may rotate the pair of rotational frames 500 at the same time and same speed simply by holding and moving the handle 700 up or down.

As described above, since the apparatus for pressing the plunger to form the ingot according to the present invention may press the plunger 20 inserted in the molding frame 10 only by moving the handle 700 down, using the apparatus is very easy. Also, since a structure necessary for pressing the plunger 20 is simple, manufacturing costs for an entirety of the apparatus become decreased.

Also, since it is possible to quickly perform another pressing process after one pressing process is completed, productivity is increased.

Figure 2:
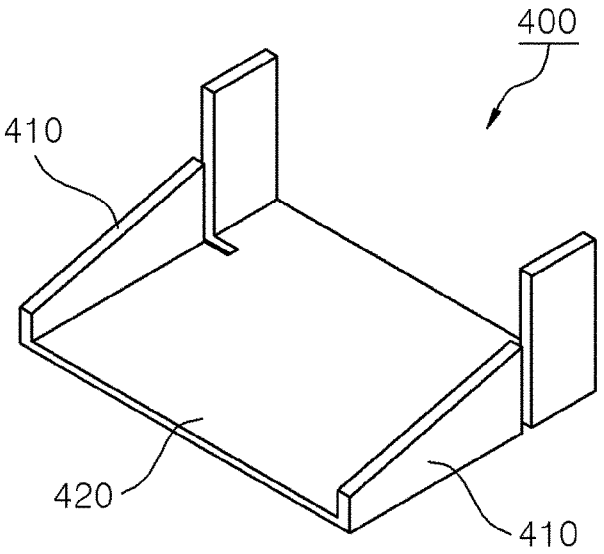
FIG. 2 is a perspective view illustrating a sliding block of the apparatus for pressing the plunger to form the ingot according to the present invention.

FIG. 2 is a perspective view illustrating the sliding block 400 included in the apparatus for pressing the plunger to form the ingot according to the present invention.

The greatest distinction of the sliding block included in the present invention is being configured to be easily slidable along the longitudinal direction of the guide rails 200, that is, a tilting direction of the tilted surface 110, while remaining in a state of being mounted between the pair of guide rails 200.

Here, it is necessary to manufacture the sliding block to have high structural strength to press the plunger 20 with a great force as well as to have a light weight to be easily moved up by a user without a great force.

Accordingly, to maintain high structural strength in comparison to a weight thereof, the sliding block may include a pair of side plates 410 mounted on inner surfaces of the pair of guide rails 200 and a pressing plate 420 which is disposed to be parallel to a top surface of the support 300 and connects the pair of side plates 410.

When the sliding block is manufactured to have a plate shape bent in a staple shape as described above, an overall weight is very small such that the user does not consume a great force to move the sliding block up and the pressing plate 420 is not easily deformed during a process in which the pressing plate 420 presses the plunger 20. Accordingly, the plunger 20 may be pressed with an adequately great force.

Figure 3:
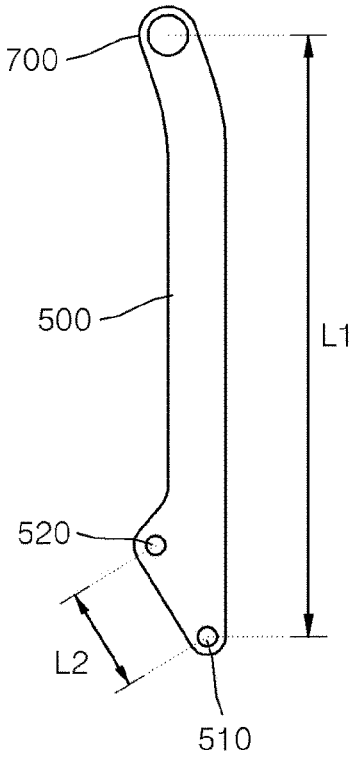
FIG. 3 is a side view illustrating rotational frames included in the apparatus for pressing the plunger to form the ingot according to the present invention.

FIG. 3 is a side view illustrating the rotational frames 500 included in the apparatus for pressing the plunger to form the ingot according to the present invention.

The greatest distinction of the apparatus for pressing the plunger to form the ingot according to the present invention is a greatest feature that the rotational frames 500 moves up the sliding block 400 using a lever structure to press the plunger 20 with a very great force even when a force of the user who rotates the rotational frames 500 is small.

That is, the rotational frames 500 include hinge fastening holes 510 coupled to the guide rails 200 in a rotatable structure and link fastening holes 520 coupled to the connection links 600 in a rotatable structure. Here, a distance L1 between the hinge fastening holes 510 and the handle 700 may be set to be two times or greater than a distance L2 between the hinge fastening holes 510 and the link fastening holes 520.

When the distance L1 between the hinge fastening holes 510 and the handle 700 is set to be two times or greater than the distance L2 between the hinge fastening holes 510 and the link fastening holes 520, even when a force of the user who rotates the rotational frames 500 while holding the handle 700 is small, a great pulling force of the connection links 600 moving down the sliding block 400 occurs such that the plunger 20 may be pressed by an adequately great force.

Here, when a difference between the distance L1 between the hinge fastening holes 510 and the handle 700 and the distance L2 between the hinge fastening holes 510 and the link fastening holes 520 is excessively great, a movement distance of the sliding block 400 is decreased when the rotational frames 500 are rotated. When the difference between the distance L1 between the hinge fastening holes 510 and the handle 700 and the distance L2 between the hinge fastening holes 510 and the link fastening holes 520 is excessively small, a force of the sliding block 400 pressing the plunger 20 becomes decreased. Accordingly, the difference between the distance L1 between the hinge fastening holes 510 and the handle 700 and the distance L2 between the hinge fastening holes 510 and the link fastening holes 520 may be adequately determined.

Figure 4:
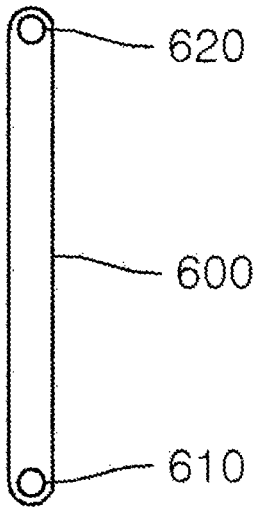
FIG. 4 is a side view illustrating connection links included in the apparatus for pressing the plunger to form the ingot according to the present invention.
Figure 5:
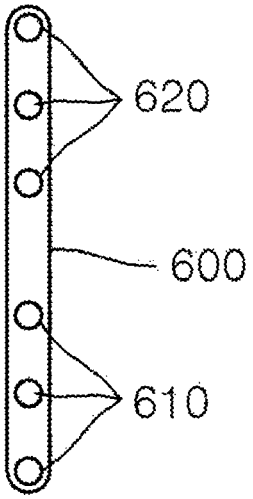
FIG. 5 is a side view illustrating a second example of the connection links included in the apparatus for pressing the plunger to form the ingot according to the present invention.

FIG. 4 is a side view illustrating the connection links 600 included in the apparatus for pressing the plunger to form the ingot according to the present invention, and FIG. 5 is a side view illustrating a second example of the connection links 600 included in the apparatus for pressing the plunger to form the ingot according to the present invention.

The connection links 600 are configured to include frame fastening holes 610 coupled to the rotational frames 500 in a rotatable structure and block fastening holes 620 coupled to the sliding block 400 in a rotatable structure.

Here, when a height of the molding frame 10 mounted on the support 300 or a length of the plunger 20 is changed, it is necessary to change a height of the sliding block 400. As shown in FIG. 4, when one frame fastening hole 610 and one block fastening hole 620 are provided, it is impossible to change an installation height of the sliding block 400 unless the connection links 600 are replaced with another specification.

Accordingly, in the apparatus for pressing the plunger to form the ingot according to the present invention, as shown in FIG. 5, two or more of the frame fastening holes 610 and two or more of the block fastening holes 620 may be arranged along a longitudinal direction of the connection links 600 so as to freely adjust the installation height of the sliding block 400 using only one of the connection links 600.

When two or more of the frame fastening holes 610 and two or more of the block fastening holes 620 are arranged along the longitudinal direction of the connection links 600 as described above, since a mounting height of the sliding block 400 may be freely changed depending on which ones of the frame fastening holes 610 are connected to the rotational frames 500 and which ones of the block fastening holes 620 are connected to the sliding block 400 by the user, even when specifications of the molding frame 10 and the plunger 20 are changed, the apparatus for pressing the plunger to form the ingot according to the present invention may be commonly used.

Figure 6:
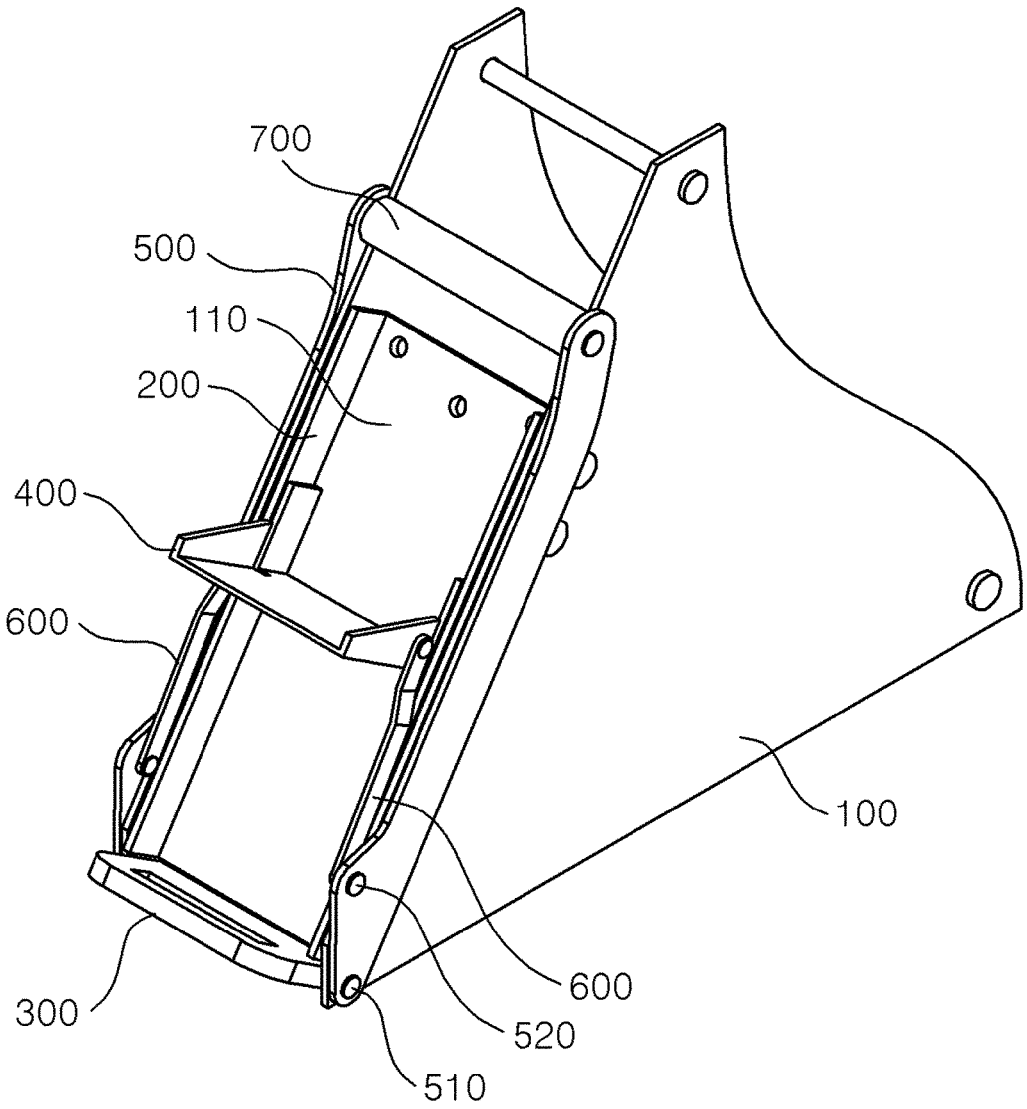
FIGS. 6 to 8 are usage state views of using the apparatus for pressing the plunger to form the ingot according to the present invention.
Figure 7:
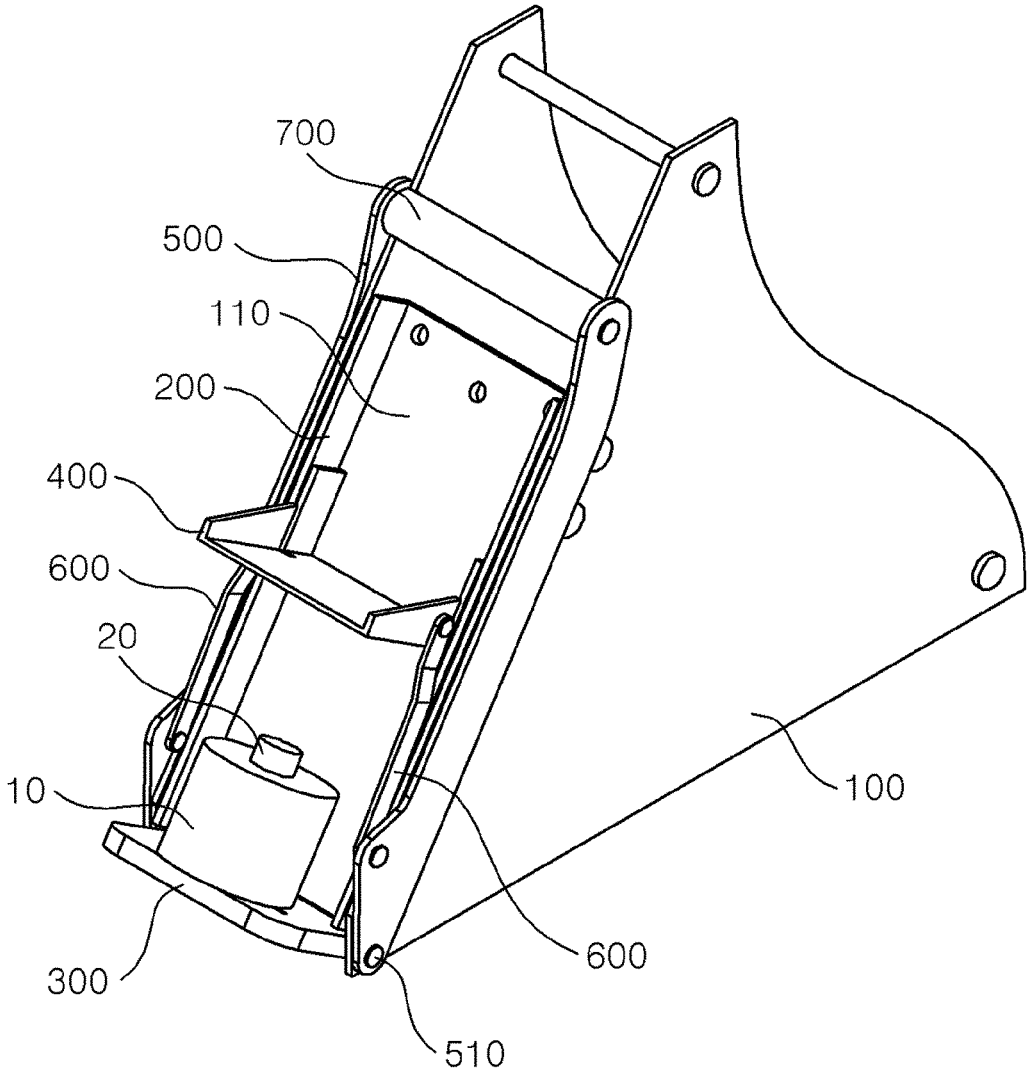
Figure 8:
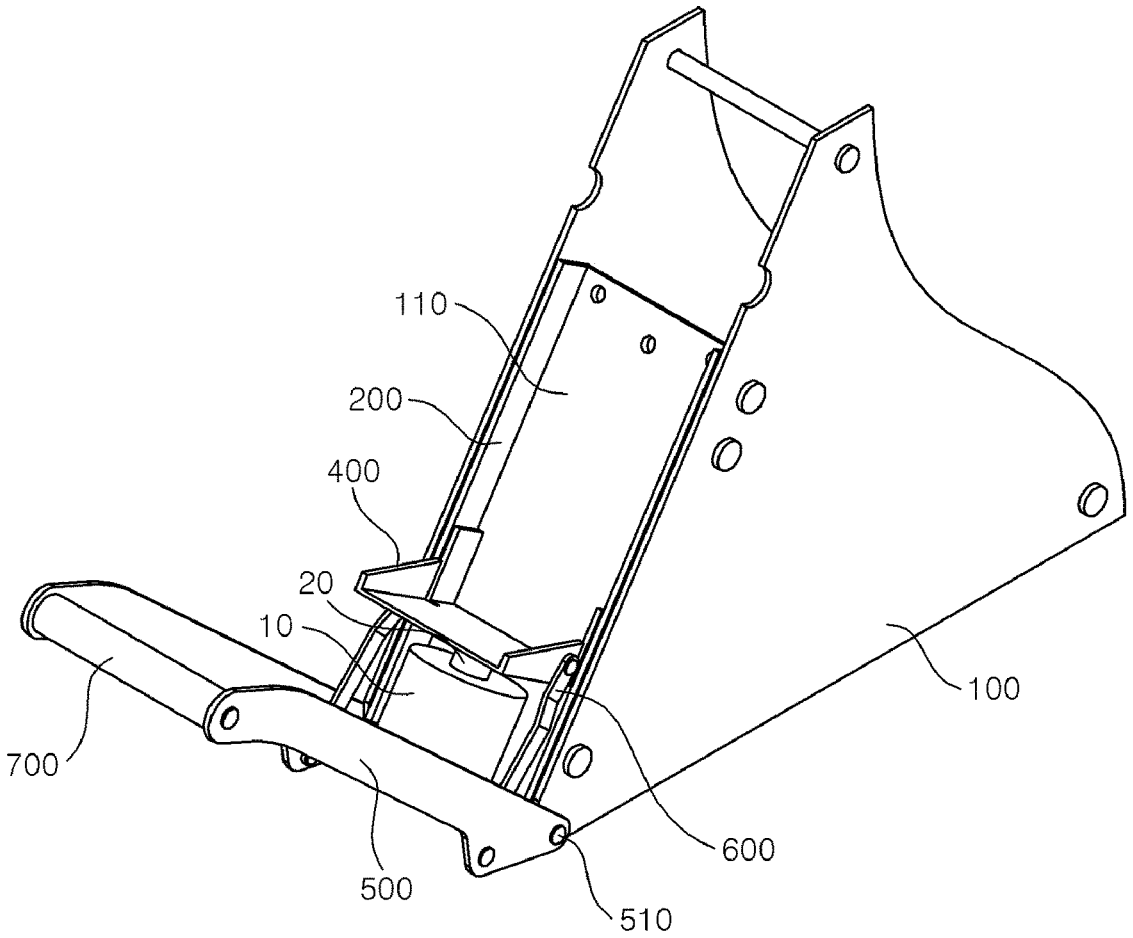

FIGS. 6 to 8 are usage state views of using the apparatus for pressing the plunger to form the ingot according to the present invention.

In order to press the plunger 20 using the apparatus for pressing the plunger to form the ingot according to the present invention, first, the sliding block 400 is located as high as possible by rotating the rotational frames 500 toward the guide rails 200 as much as possible as shown in FIG. 6 and then the molding frame 10 is mounted on the support 300 as shown in FIG. 7.

When the molding frame 10 is completely mounted, the user moves the sliding block 400 down by holding the handle 700 with his or her hand and rotating the handle 700 counterclockwise (to be precise, in a direction away from the guide rails 200). The sliding block 400 moving down along the tilted surface 110 presses the plunger 20 toward an inside of the molding frame 10 such that the ingot mounted in the molding frame 10 is pressed by the plunger 20 and molded in a particular preset shape.

As described above, the apparatus for pressing the plunger to form the ingot according to the present invention has a very simple structure and is very simply manipulated, manufacturing costs thereof may be reduced and productivity thereof may be increased.

Although the exemplary embodiment of the present invention has been described above in detail, the scope of the present invention is not limited to a particular embodiment and should be defined by the following claims. Also, it should be understood by one of ordinary skill in the art that a variety of modifications and changes may be made without departing from the scope of the present invention.

INDUSTRIAL APPLICABILITY

The present invention is applicable to the field of an apparatus for pressing a plunger to form an ingot due to a simple structure which reduces manufacturing costs and is easily operated to have excellent productivity.

What is claimed is:

1. An apparatus for pressing a plunger to form an ingot, comprising:

a base block (100) having a tilted surface (110);

a pair of guide rails (200) disposed on left and right sides of the tilted surface (110) of the base block (100);

a support (300) disposed at a right angle with the tilted surface (110) on bottom ends of the guide rails (200) and on which a molding frame (10) is mounted;

a sliding block (400) which slides along the pair of guide rails (200) and presses a plunger (20) protruding upward from the molding frame (10), comprised a pair of sliding plates (410) mounted on inner surfaces of the pair of guide rails (200) and a pressing plate (420)

disposed to be parallel to the top surface of the support (300) to connect the pair of side plates (410);

a pair of rotational frames (500) coupled to be rotatable on hinges mounted below the pair of guide rails (200) and connected a handle (700) on top ends of the pair of rotational frames (500); and a pair of connection links (600) having both longitudinal sides connected to the sliding block (400) and the rotational frames (500) in a rotatable structure to move the sliding block (400) downward when the rotational frames (500) rotate downward.

2. The apparatus of claim 1, wherein the rotational frames (500) comprise hinge fastening holes (510) coupled to the guide rails (200) in a rotatable structure and link fastening holes (520) coupled to the connection links (600) in a rotatable structure, and wherein a distance between the hinge fastening holes (510) and the handle (700) is two times or greater than a distance between the hinge fastening holes (510) and the link fastening holes (520).

3. The apparatus of claim 1, wherein the connection links (600) comprise frame fastening holes (610) coupled to the rotational frames (500) in a rotatable structure and block fastening holes (620) coupled to the sliding block (400) in a rotatable structure, and wherein two or more of the frame fastening holes (610) and two or more of the block fastening holes (620) are arranged along a longitudinal direction of the connection links (600).

* * * * *